United States Patent [19]

Kammann

[11] 3,955,495

[45] May 11, 1976

[54] SIDE WALL PRINTING APPARATUS FOR CONTAINERS OF NON-CIRCULAR CROSS-SECTION

[76] Inventor: Wilfried Kammann, Elsemuhlenweg, 498 Bunde (Westfalen), Germany

[22] Filed: May 6, 1974

[21] Appl. No.: 467,245

[30] Foreign Application Priority Data

May 7, 1973 Germany ..... 2322975

[52] U.S. Cl. ..... 101/38 A; 269/48.1; 269/49; 269/51; 279/2 R

[51] Int. Cl.[2] ..... B41F 17/26

[58] Field of Search ..... 101/38 R, 38 A, 39, 101/40, 126; 269/49, 52, 50, 51, 48.1, 48, 47; 279/2 R; 51/103 WH; 156/457

[56] References Cited

UNITED STATES PATENTS

| | | | |
|---|---|---|---|
| 1,946,483 | 2/1934 | Casto et al. | 101/38 R X |
| 2,856,058 | 10/1958 | Todd et al. | 101/38 R X |
| 2,881,699 | 4/1959 | Hakogi | 101/39 X |
| 3,019,725 | 2/1962 | Freeman | 101/38 R |
| 3,162,115 | 12/1964 | Bauer | 101/39 |
| 3,364,628 | 1/1968 | Bennett | 269/47 X |
| 3,411,439 | 11/1968 | Moes et al. | 101/38 R |
| 3,777,097 | 12/1973 | Budzinski | 269/48.1 X |

FOREIGN PATENTS OR APPLICATIONS

| | | | |
|---|---|---|---|
| 488,566 | 5/1970 | Switzerland | 101/38 R |
| 1,099,288 | 3/1955 | France | 101/38 R |

*Primary Examiner*—Clifford D. Crowder
*Attorney, Agent, or Firm*—Edwin E. Greigg

[57] ABSTRACT

A printing machine for applying printed matter to the outside of dished articles, particularly plastics containers for packaging food stuffs, of non-circular cross-section has a rotary printing drum associated with a revolving head, with supports for the articles, arranged to be indexed past the printing drum and is characterised by each support having an arbor which is operative to support an article throughout the printing operation and at least one additional arbor spaced therefrom and displaceable between an operative position in which it also supports the article and an inoperative position in which it does not support the article. A vacuum, applied through a frontal aperture in the first-mentioned arbor may be provided to assist in retaining the articles on their supports. Alternatively or additionally the articles may be held on to their supports by means of rollers acting on the outside of the articles.

11 Claims, 8 Drawing Figures

SIDE WALL PRINTING APPARATUS FOR CONTAINERS OF NON-CIRCULAR CROSS-SECTION

BACKGROUND OF THE INVENTION

The invention relates to a printing machine having a printing drum with which there is associated an intermittently indexable transporting element for the articles to be printed which are of non-circular cross-section, the supports of the transporting element having a rotatably supported arbor supporting the article internally thereof.

From the published German specification 2039880 such a printing machine is known which is adapted for the printing of non-circular hollow bodies. Since no further means, other than the internally arranged rotatably supported arbor, are provided for supporting the article to be printed, it is possible to set a particular initial position at the beginning of the printing operation only by the operator holding the article in a particular initial position firmly until the article is held between the arbor and the printing drum by these two last-mentioned parts. Automatic feeding of the article to be printed to the printing drum and automatic removal of the printed article upon completion of the printing operation are consequently not possible, so that the throughput capacity of the known machine is necessarily small.

OBJECTS AND SUMMARY OF THE INVENTION

It is, inter alia, an object of the invention, to construct a printing machine of the kind hereinbefore described in such a way that the articles which are of non-circular cross-section experience a definite alignment with respect to the printing drum and to the printing sheet disposed thereon; i.e. it is intended to make it possible for the article to be brought into a particular initial position with respect to the printing drum. A further object of the invention is to make automatic transmission of the articles to the supports of the transporting elements possible, without the need for changing the supports in dependence on the cross-sectional shape of the articles.

In order to achieve these objects, the invention proposes that the rotatably supported arbor has associated therewith at least one additional arbor spaced from the latter and the spacing between the two arbors corresponds to the cross-sectional dimensions of the article to be printed, the additional arbor being secured inside the article in such a way that it can be brought into an inoperative position. The additional arbor may also be rotatable about its longitudinal axis. In general the arbors will be arranged parallel to each other. The fact that mention is made throughout of "a" or "the" additional arbor is not intended to exclude the possibility of using two or more additional arbors.

A configuration which has been found particularly advantageous is one in which the additional arbor is arranged for slidable displacement transversely to its axis inside the article. In the printing of cup- or can-like containers, which are generally made from plastics sheet by a deep-drawing process and which are used in the packaging particularly of foodstuffs, e.g. butter, margarine, soft cheeses or the like, the additional arbor, in the course of the transmission of the article to be printed from a supply stack to the support of the transporting element, serves the purpose of bringing the article into its particular position with respect to this support and hence with respect to the printing drum at the printing station. Directly prior to, or at the commencement of, the printing process proper, the second arbor — and, possibly further additional arbors — are slidably displaced into an inoperative position, i.e. inwardly of the container, so that the latter is held only by one of the arbors which is contiguous from the inside, and by the printing drum which is contiguous from the outside. In this way the printing operation may be carried out at remarkably high speed, so that the throughput capacities of the known printing machines by means of which articles of circular cross-section are printed, can be achieved without difficulty. It is merely necessary for the rotatably supported arbor to have a radius which is not or not appreciably larger than the radius of the areas of the article to be printed which have the smallest radius of curvature. These will practically always be the rounded edges between two adjacent flat areas of the article or such adjacent areas which are only slightly curved, i.e. have a large radius of curvature. In the case of the containers previously mentioned, which are made from plastics sheet or some comparable material, it is not necessary for the radius of the rotatably supported arbor to be as large as or smaller than the radius of the area having the smallest radius of curvature since, in view of the very high speed with which the article moves about the arbor, the shape of the cross-section of the article is in any case subjected to a certain degree of alteration in the course of the printing operation. Furthermore in this case the wall of the container is so thin that, on account of its compression between the arbor and the printing roller, it is subjected to a certain amount of deformation in the region of its edges, and the printing rubber is also deformed, so that the printing medium is satisfactorily transmitted. Any distortion of the latter which might take place is so moderate that it cannot be observed by the naked eye. For the purpose of printing articles of approximately rectangular or square cross-section, two arbors per support will be so arranged that they are associated in the initial position diagonally opposite each other inside the article with two edge regions of the article. It is moreover advantageous to provide at least one of the arbors, preferably a stationary arbor, with frontal apertures which may be connected to a source of vacuum. In this way it is possible to bring the second arbor into its inoperative position even before commencement of the printing operation, since the container is retained in position against the arbor which has the apertures, by virtue of the vacuum, until the printing cylinder and the printing sheet come to operate on the area to be printed. This may also be achieved by associating the end of the stationary arbor with a counter-roller which presses against the outside of the floor of the article. The vacuum and/or the counter-roller perform the additional function of preventing any axial displacement of the article in the course of its transportation and/or the printing operation.

A significant advantage of the invention resides in the simple and rational construction of the supports. The latter also have the advantage that they can, without difficulty, be adapted to different diameters and cross-sectional dimensions of the articles. It is merely necessary to vary the spacing between the arbors. It is generally not necessary to provide new supports when the shape or the size of the articles to be printed is changed. In accordance with a further proposal of the invention, the arrangement may be such that the arbors of any one support are secured to a common baseplate which is secured to the transporting element which is advantageously in the form of a revolving head. The slidably displaceable arbor may be carried by a pivotable arm which is preferably supported by the baseplate. Desirably the arrangement is such that the said arm is part of a two-armed lever whose second arm carries a cam roller or the like which co-operates with a cam disc. The latter may be loosely arranged on the power take-off shaft of the indexing gear for the supporting element. It is furthermore desirable to associate with the slidably displaceable arbor a spring element, which exerts on the arbor a force in the direction of one of the two terminal positions.

Furthermore a track may be secured to the drive shaft of the indexing gear, the roller or the like which co-operates with this track being supported by a connecting rod which engages the cam disc which controls the additional arbor.

The invention further envisages the possibility of arranging the axes of rotation of the printing drum and of the transporting element in mutually perpendicular planes. It is furthermore desirable to arrange the arbors of the supports in or parallel to a plane extending at right angles to the axes of rotation of the transporting element. In the result, the arbor or the effective arbor extends parallel to the axes of rotation of the printing drum at the printing station.

An embodiment of the invention is shown diagrammatically in the drawing.

BRIEF DESCRIPTION OF THE DRAWINGS

FIGS. 1*a*–4*a* show the side view of an offset printing machine in successive operating phases, FIGS. 1*b*–4*b* show the corresponding plan views.

DESCRIPTION OF THE PREFERRED EMBODIMENTS

Figure 1A:
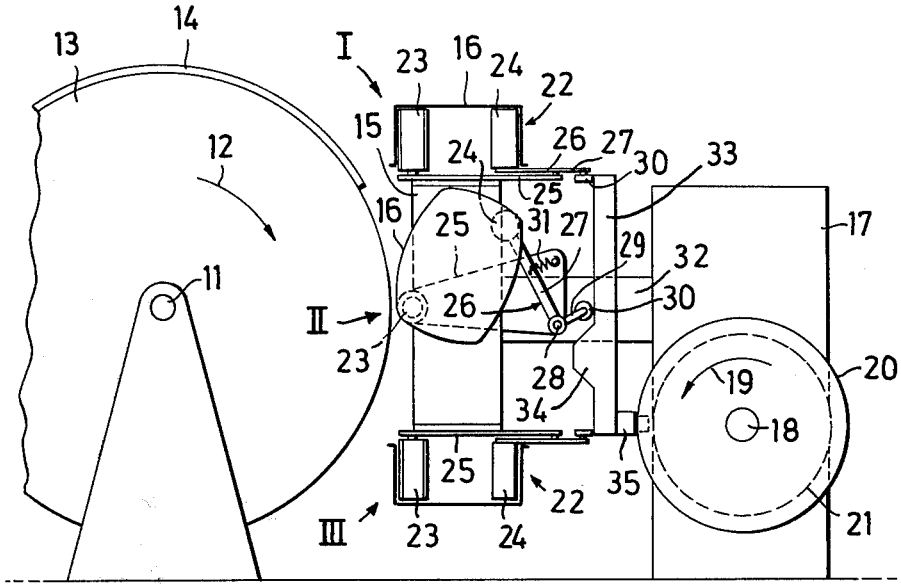

The embodiment shown in the drawing consists essentially of a printing drum 13, which rotates about an axis 11 in the direction of the arrow 12 and on the surface of which a printing sheet 14 is disposed, which extends only over part of the circumference of the surface area, transporting means, in the form of a revolving head 15, for the containers 16 which are to be printed and are in the form of cups, as well as an indexing gear 17 to whose driving shaft 18 a roller 20 is secured which is driven in the direction of the arrow 19 and whose surface is provided with a track 21.

The revolving head 15 is provided with a number of supports 22 for the containers 16 which are to be printed. In the embodiment shown in the drawing, the revolving head 15 has four supports 22, each of which comprises two arbors 23, 24. At every indexing step, the revolving head 15 is advanced by an arc of 90°. Depending on the prevailing circumstances, it is, however, also perfectly possible to choose a different number of supports 22. This will, inter alia, depend on the size of the revolving head 15, the dimensions of the articles to be printed and other circumstances.

In particular, the arrangement is such that a number of base plates 25 corresponding to the number of supports 22 are secured to the revolving head 15. Each base plate carries an arbor 23 rotatable about its longitudinal axis, which otherwise does not change its position in the course of transportation during the printing operation and other operations.

The second arbor 24 of each support 22 is carried by an arm 26 of a two-armed lever 27, which is secured to the base plate 25 for pivoting about the centre of rotation 28. The second arm 29 of this two-armed lever 27 carries a cam roller 30 near its free end. A tension spring 31 is applied to the arm 26 and its other end is secured to the base plate 25. The arrangement is such that in the initial position of the two arbors 23 and 24 in accordance with FIGS. 1*a* and 1*b* of the drawing the distance therebetween corresponds to the cross-sectional dimensions of the article 16 to be printed.

The power take-off shaft 32 of the gear, to whose free end the revolving head 15 is fixedly secured, also acts as the seat for a cam disc 33 which has a lobe 34. The cam roller 30 which is carried by the second arm 29 of the lever 27 co-operates with this cam disc 33. The drive for the latter is provided via the roller 20, whose track 21 co-operates with a cam roller 36 carried by a rod 35. The other end of the rod 35 is pivotably and eccentrically — with respect to the centre of the cam disc 33 — secured to the latter. The path of the track 21 of the roller 22 is so chosen that the rotation of the roller 20 in the direction of the arrow 19 causes a to-and-fro rotational movement of the cam disc 33, the arcuate extent of this to-and-fro movement being relatively small and in any event only insignificantly larger than the width of the lobe 34 in the circumferential direction of the cam disc 33.

Figure 1B:
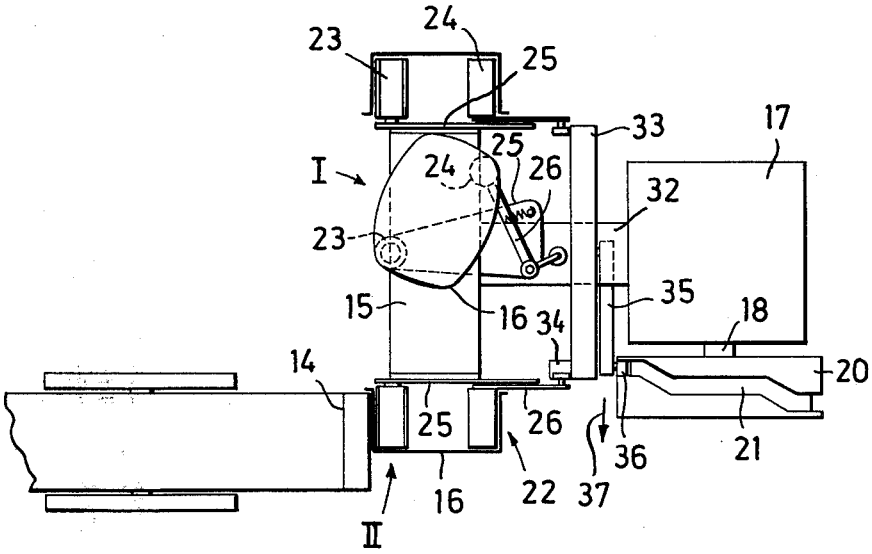
Figure 2A:
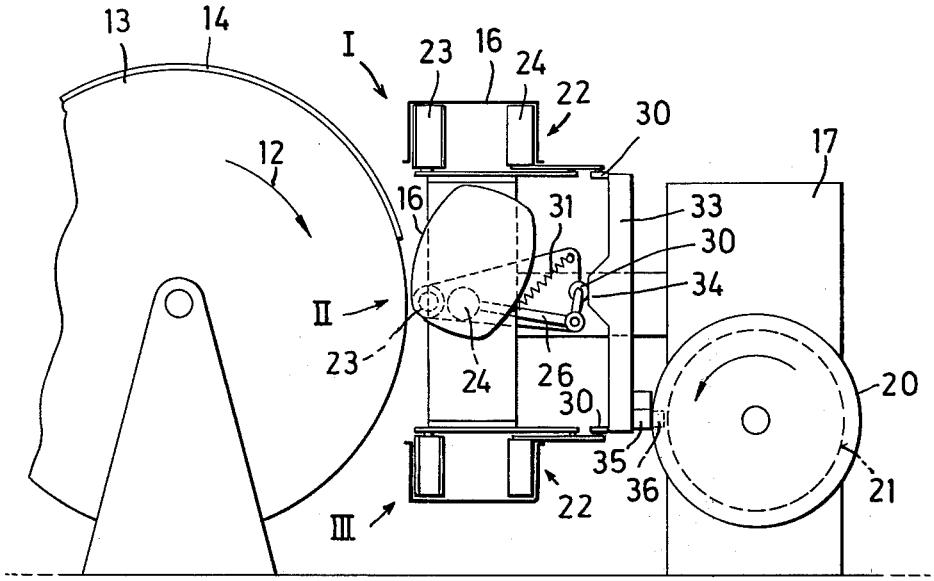
Figure 2B:
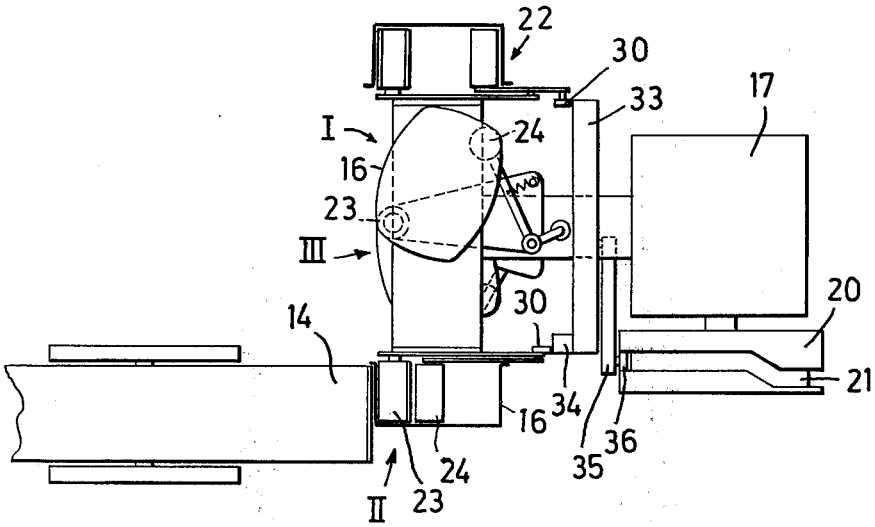

The offset printing machine operates in such a manner that the bottom container 16 of a stack thereof disposed above the revolving head (not shown in the drawing) is led downwardly over the two arbors 23 and 24 of the support 22, which at that particular time is disposed at the reception station I. At the latter the arbors 23 and 24 are vertically upwardly directed. Thereafter the revolving head 15 is advanced through 90° so that the support 22 with the container 16 disposed thereon is taken to the printing station II. This happens in the course of a pivotal movement through 90°. The vacuum mentioned in the introduction may already at this stage be effective via one of the two arbors 23, 24 or via both of the arbors or from a third source, so that in spite of the rapid indexing movement from the reception station I to the printing station II, the container 16 is not thrown off the two arbors 23, 24. Upon arrival at the printing station II the track 21 in the roller 20 pulls the connecting rod 35 in the direction of the arrow 37 (FIG. 1*b*). Thereby a rotary movement is transmitted to the cam disc 33, which causes the lobe 34 of this cam disc to act upon the cam roller 30 of the two-armed lever 27. This in turn has the effect of pivoting the lever 27 and the arbor 24 carried by it against the force of the tension spring 31 from the position according to FIG. 1*a* and FIG. 1*b* into the position according to FIGS. 2*a* and 2*b*. That means that the arbor 24 is brought into an inoperative position inside the article or container 16. Nevertheless the article 16 initially remains in its position as shown in FIGS. 1*a* and 2*a* as well as 1*b* and 2*b* at the printing station II, namely by reason of the previously mentioned vacuum, which becomes effective via the arbor 23. Instead of the vacuum other means could also be used, e.g. a counter-pressure roller or the like acting against the floor 38 of the container.

Figure 3A:
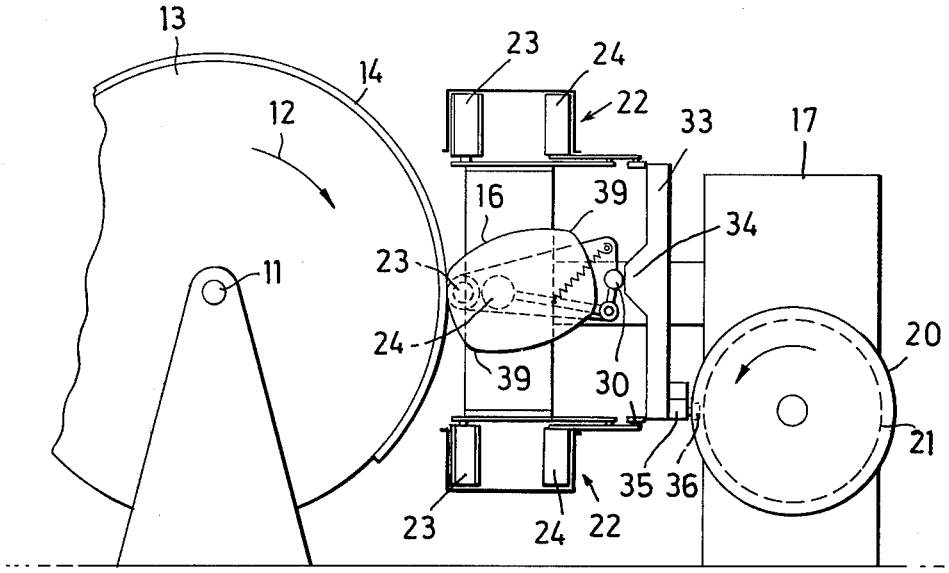
Figure 3B:
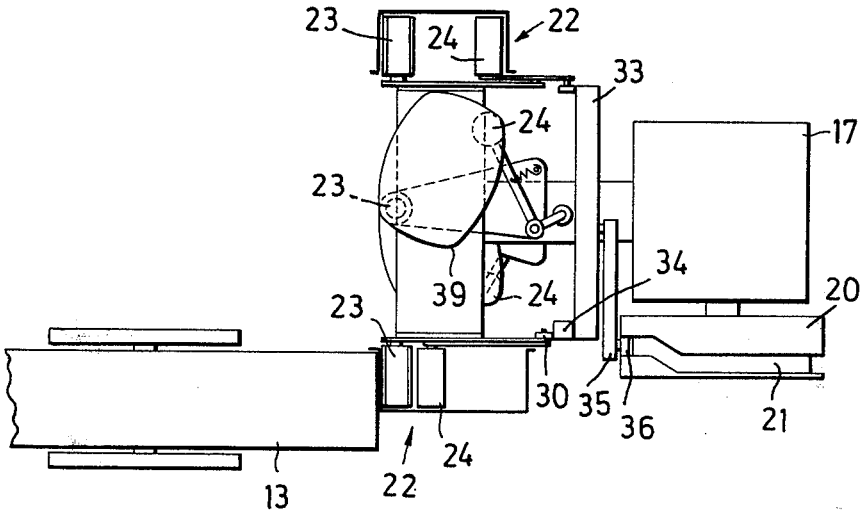

After the arbor 24 has been pivoted into the inoperative position the printing sheet 14, in the course of the rotation of the printing cylinder 13 in the direction of the arrow 12, reaches the article 16 which is disposed at the printing station II and which is carried along by the printing sheet and rolls round the arbor 23 in a manner known per se. The FIGS. 3*a* and 3*b* show the position of the parts in the course of the application of the printed matter. It is, however, perfectly possible to provide the container 16 with printed matter extending over the whole of its circumference in one operation, the printed matter also extending over the somewhat rounded edges 39 of the container or article 16. On the other hand, it is of course also possible to apply one or more mutually spaced prints in one operation. The deciding factor is merely the manner in which the printing sheet has been prepared. With the apparatus according to the invention it is, in any case, possible to print all four sides and also the regions of the edges 39 in one operation. The same also applies to articles of different, e.g. triangular or polygonal cross-section. Any axial displacement of the article 13 whilst being carried along by the printing sheet 14 is avoided by the effect of the vacuum previously mentioned or by a counter-pressure roller or the like.

Figure 4A:
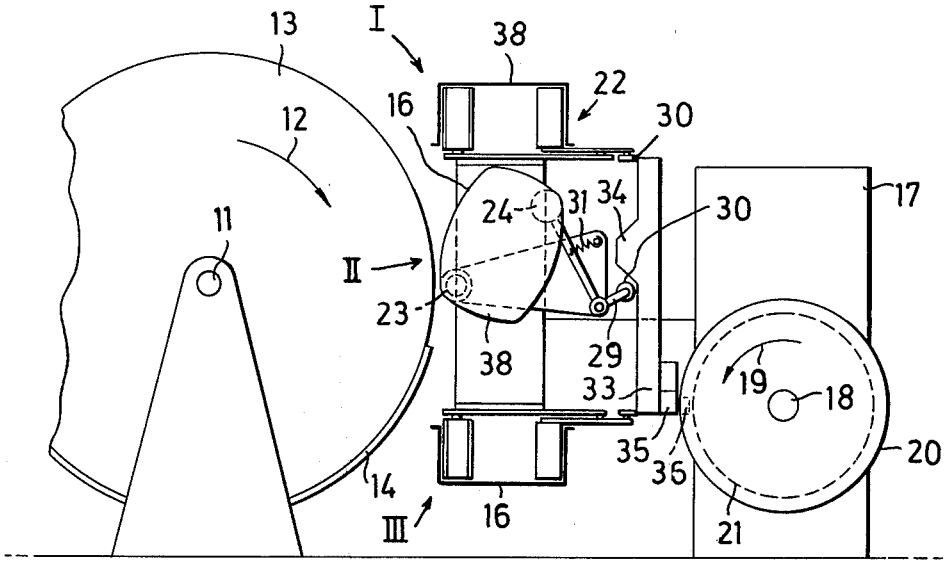
Figure 4B:
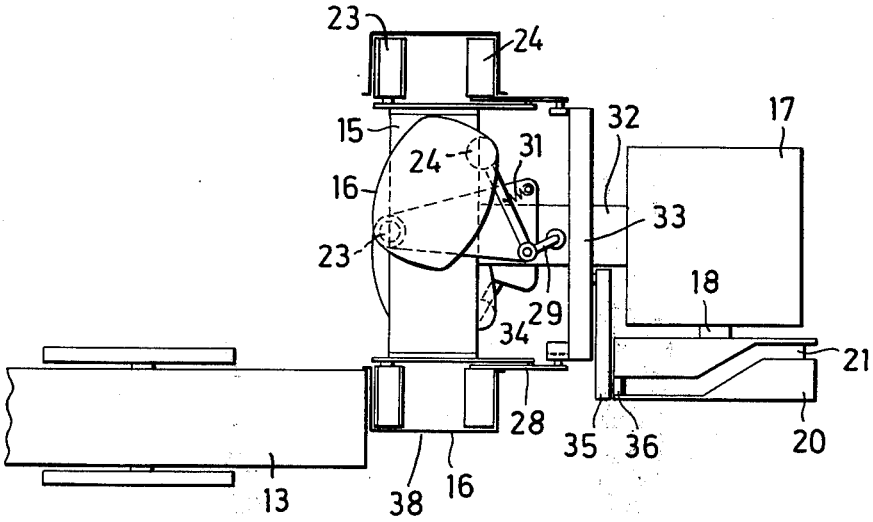

In the position adopted by the parts in FIGS. 4*a* and 4*b*, the printing sheet 14 has passed the article 16. The printing operation has been completed. The article 16 again assumes the initial position shown in FIGS. 2*a* and 2*b* of the drawing, although the second arbor 24 has already been pivoted back into its initial position. This may take place immediately before the printing operation has been completed. It is effected by a further movement of the movement of the connecting rod 35 in the direction of the arrow 37 caused by the track 21, which causes the further rotation of the cam disc 33, so that the lobe 34 of the cam disc 33 is moved over the cam roller 30 of the lever 27, so that, under the influence of the force of the spring 31, the lever 27 is returned into its original position according to FIGS. 1*a* and 1*b*. Thereafter the revolving head 15 is indexed on through a further 90° with the result that the container 16 which has just been printed arrives at the discharge station III in which the article 16 is stripped off the arbors 23 and 24 downwardly in some suitable manner. This may, for example, by done by applying a pressure instead of the vacuum to the arbor or arbors, by means of which the container is blown off the arbors. Any other possible mechanical or other means may however be used to withdraw the container 16 from the arbors 23 and 24.

In the course of the pivotal movement of the support 22 from the printing station II to the discharge station III, the cam disc 33 which is disposed on the drive shaft 32 is rotated back into its initial position in accordance with FIGS. 1*a* and 1*b*. After two further indexing steps of the revolving head 15, the support 22 returns from the discharge station III to the reception station I in order to receive a further article and to transport it to the printing station II in the course of the next indexing step. In this way continuous, automatic operation of the printing machine is provided, and it is perfectly possible, when printing non-circular articles, to bring the latter into a particular initial position with respect to the printing drum 13.

The support 22 may readily be adapted to articles of different sizes and cross-sectional shapes by appropriate adjustment of the arbors 23 and 24. This adjustability may, for example, readily be achieved by making the arbor 23 and the pivot point 28 of the lever 27 adjustable and securable on the base plate 25 transversely to their longitudinal axes.

I claim:

1. A printing machine comprising a rotary printing drum, a transporting element having a plurality of supports for dished articles to whose surface printed matter is to be applied and being arranged for intermittent indexing of said supports into printing relationship with said printing drum at a printing station, drive means for said printing drum and transporting element, said supports each comprising a first arbor rotatable about its longitudinal axis and operative to support said article inside said article and at least one additional arbor arranged to be displaceable from a first position in which it is laterally spaced a first distance from said first arbor and operative to support said article inside said article to a second position laterally spaced a second distance from said first arbor inside said article in which second position it is inoperative to support said article, and means for cyclically moving said at least one additional arbor between said first and said second positions at said printing station.

2. A printing machine according to claim 1, wherein said additional arbor is also rotatable about its longitudinal axis.

3. A printing machine according to claim 1, wherein said additional arbor is arranged for slidable displacement transversely to its axis inside said article.

4. A printing machine according to claim 3, comprising a spring element associated with said at least one additional arbor so as to bias the latter into one of said first and said second positions.

5. A printing machine according to claim 1, wherein said transporting element is defined by a revolving head and wherein each said support comprises a base plate to which said first and said at least one additional arbor are secured with their longitudinal axes parallel.

6. A printing machine according to claim 5, wherein a pivotable arm is supported by said base plate and carries said at least one additional arbor, the latter being arranged for slidable displacement transversely to its axis inside said article.

7. A printing machine according to claim 5, wherein the axis of rotation of said printing drum is in a plane perpendicular to the axis of rotation of said revolving head.

8. A printing machine according to claim 5, wherein the longitudinal axes of said first and said at least one additional arbor are arranged in planes perpendicular to the axis of rotation of said revolving head.

9. A printing machine comprising: a rotary printing drum; a transporting element defined by a revolving head, said transporting element having a plurality of supports for dished articles to whose surface printed matter is to be applied and being arranged for intermittent indexing of said supports into printing relationship with said printing drum; drive means for said printing drum and transporting element, said supports each comprising: a first arbor rotatable about its longitudinal axis and operative to support said article inside said article; at least one additional arbor arranged for slidable displacement transversely to its axis inside said article from a first position in which it is spaced from said first arbor and operative to support said article inside said article to a second position inside said article in which second position it is inoperative to support said article; a base plate to which said first and said at least one additional arbor are secured with their longitudinal axes parallel; and a pivotable arm supported by said base plate on which said one additional arbor is carried, said pivotable arm comprising a two-armed lever with one arm defining said pivotable arm and the other arm carrying a cam roller; a cam disc being arranged for cooperation with said cam roller; and means for cyclically moving said at least one additional arbor between said first and said second positions.

10. A printing machine according to claim 9, comprising an indexing gear for performing said intermittent indexing of said transporting element, and a power take-off shaft for said indexing gear, said cam disc being loosely arranged on said power take-off shaft.

11. A printing machine according to claim 9, comprising an indexing gear for performing said intermittent indexing of said transporting element, a drive shaft for said indexing gear, a track secured to said drive shaft, a connecting rod arranged to cooperate with said track.

* * * * *